United States Patent [19]

Brand et al.

[11] 4,304,066

[45] Dec. 8, 1981

[54] APPARATUS FOR COUPLING AND UNCOUPLING TOY TRUCK TRACTORS AND SEMITRAILERS

[76] Inventors: Derek A. Brand, 965 Camino Concordia, Camarillo, Calif. 93010; Derek R. Brand, 126 Ash Ave., Apt. #15, Carpinteria, Calif. 93013

[21] Appl. No.: 40,860

[22] Filed: May 21, 1979

[51] Int. Cl.[3] ..... A63H 11/10

[52] U.S. Cl. ..... 46/202; 46/257; 46/219; 46/1 K; 104/248; 104/305; 105/157 T

[58] Field of Search ..... 46/219, 216, 217, 218, 46/202, 201, 215, 257, 259, 260, 261; 280/504, 433, 423 R, 431, 425 R, 427, 446 R; 104/DIG. 1, 248, 242, 305; 105/157 T; 213/75 TC, 75 A; 414/337, 389, 333

[56] References Cited

U.S. PATENT DOCUMENTS

| | | | |
|---|---|---|---|
| 873,795 | 12/1907 | Sanford | 104/248 |
| 1,308,764 | 7/1919 | Olds | 414/389 X |
| 2,178,035 | 10/1939 | Dunhill | 104/DIG. 1 |
| 2,602,266 | 7/1952 | Preston | 46/201 |
| 2,866,418 | 12/1958 | Petrick, Sr. | 46/216 X |
| 2,871,026 | 1/1959 | Hotchkiss, Sr. | 280/433 X |
| 3,016,024 | 1/1962 | Silver | 46/216 X |

FOREIGN PATENT DOCUMENTS

| | | | |
|---|---|---|---|
| 554575 | 6/1932 | Fed. Rep. of Germany | 104/DIG. 1 |
| 147204 | 10/1954 | Fed. Rep. of Germany | 46/216 |

*Primary Examiner*—Gene Mancene
*Assistant Examiner*—Mickey Yu
*Attorney, Agent, or Firm*—Harry W. Brelsford

[57] ABSTRACT

The apparatus provides for the automatic uncoupling of a toy semitrailer from a toy tractor truck and provides also for automatic coupling of a toy semitrailer to a toy tractor truck. The uncoupling utilizes a ramp in a roadway which is inboard of the tractor truck wheels, and this ramp is engaged by the forward dolly wheels on the semitrailer, which dolly wheels are also inboard of the truck tractor wheels. The coupling of the toy semitrailer to the toy tractor is achieved by a simple beveled end on the rear of the toy tractor, which backs up to the semitrailer, and the king pin of the semitractor rides up this bevel to the pivot flat area of the tractor to drop into the pivot hole. Both operations are carried out in the same locality by a reciprocating dock which is contacted by the semitrailer during its backing up at the time its dolly wheels ride up the ramp to release the tractor. After the tractor vehicle departs, a delayed spring action moves the dock forwardly to move the semitrailer forwardly off the ramp so that the semitrailer may then be contacted by the tractor backing up to it to connect the two vehicles.

9 Claims, 5 Drawing Figures

APPARATUS FOR COUPLING AND UNCOUPLING TOY TRUCK TRACTORS AND SEMITRAILERS

This invention relates to toy trucks and has particular reference to tractor-trailer trucks and automatic means for disconnecting the trailer from the tractor and for connecting the trailer to the tractor.

BACKGROUND OF THE INVENTION

For some time there has been a need to provide a simple and reliable construction of toy tractor and trailer trucks that permits the operator to remotely disconnect the trailer or connect a trailer to the tractor portion of the truck. The enjoyment of toy vehicles is enhanced if the child or other operator of the toy can effect actions with toys that simulate real actions without any manual operations performed by him. The seemingly magical result of coupling and uncoupling the trailer without any human actions at the vehicle is very appealing to all toy operators. While complicated magnetic couplers could be devised, we have sought to keep the construction simple and mechanical for reliability and for economy in manufacture. The remote actuation of such toys calls for power to move the tractor portion of the truck. While wind-up springs or self-contained batteries could power the vehicles, we prefer to use electrical conductors disposed along a toy roadway to energize an electric motor carried by the vehicle and geared to the driving wheels of the vehicle.

SUMMARY OF THE INVENTION

We use conventional slot-guided electrical roadways having two conductors, preferably DC current at low voltage for safety. The tractor portion of the truck is guided by a pin or vane secured to and projecting downwardly from the vehicle to fit into the slot in the roadway. Preferably also, the trailer part of the vehicle has a pin or vane guide. Such guidance eliminates the need for steerable vehicles. The tractor has a built-in motor energized by a pair of conductors that protrude from the surface of the roadway, and these are contacted by leaf springs on the vehicle to deliver current to the motor in conventional fashion.

Inasmuch as real trailers are disconnected from tractors most commonly at loading docks, we have provided a toy loading dock for our toy trailers and have made the dock reciprocating to provide a return stroke that assists in connecting or coupling the trailer to the tractor. Disconnecting is achieved by backing the truck trailer over a ramp in the track until the dolly wheels on the front of the trailer roll up the wedge or incline to lift the front of the trailer free from the truck tractor. The trailer is provided with a downwardly projecting pivot pin, and lifting this pin out of the truck tractor releases the trailer from the tractor. The truck tractor is then caused to move forwardly by remote control. We provide a spring action that slowly moves the entire dock and the trailer forward until the dolly wheels again rest on the toy roadway, at which point the trailer is level. The slow return, however, gives enough time for the tractor to move away from the trailer. When it is desired to reconnect the trailer, the tractor backs into it and is provided with a tapered rear edge so that the connecting pin on the trailer rides up the incline and into the hole in the center of the pivot area on the rear of the truck tractor. An air bellows is presently preferred to give the slow return.

Because one truck tractor can service several trailers, we provide two or more docks and a roadway switch to switch the truck tractor and the trailers from one dock to the other. Also, since the operator may wish to have two separate truck tractors, we provide means coordinated with the switch so that electric current is cut off to the non-elected track or tracks, and current is switched on to the track on which operation is desired. Such roadway switching and electric switching is useful for other purposes also.

DESCRIPTION

Various objects, advantages, and features of the invention will be apparent in the following description and claims considered together with the following drawings forming an integral part of this specification and in which:

Figure 1:
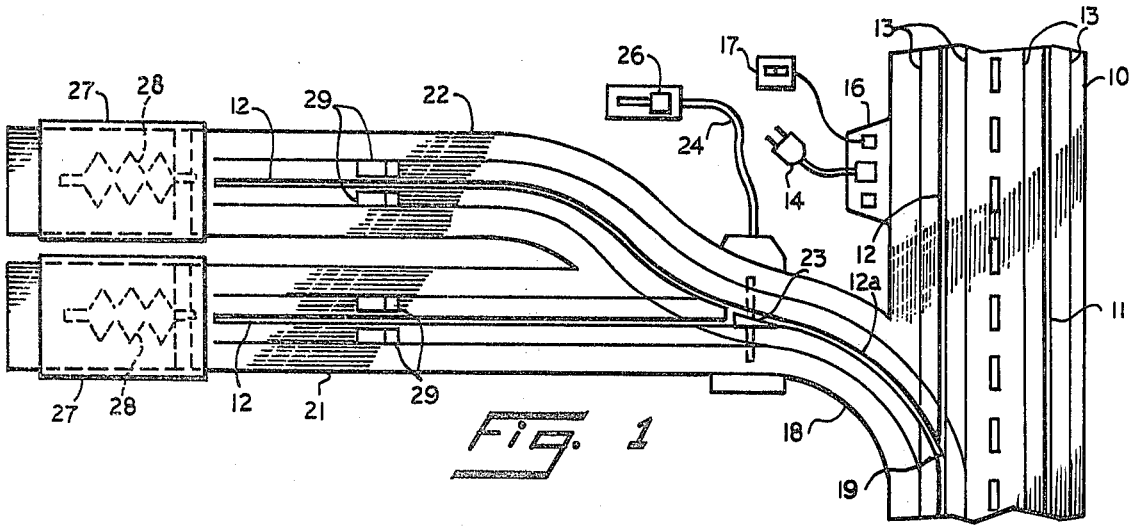
FIG. 1 is a plan view of a portion of a two-way slot roadway having a branch which in turn is divided into two roadways leading to loading docks provided particularly in accordance with the invention.

Referring to FIG. 1, there is illustrated a two-way slot roadway 10 having a guide slot 11 for traffic in one direction and a guide slot 12 for traffic in another direction. Each half of the roadway is energized by conductors 13 projecting upwardly from the roadway surface to be contacted by spring conductors attached to the bottom of tractor vehicles, as is well known in the industry. The conductors 13 are energized by electrical current obtained from a plug 14, and this may be converted to direct current in the apparatus 16. The amount of voltage and the direction of current flow in the conductors may be controlled by the manual controller 17. Projecting from the roadway 10 is a branch roadway 18, and no switch is required for the guide 12*a* of this branch, because traffic is normally downward in the lefthand track 12 and backing the tractor vehicle into the branch 18 is effected by a resilient spring 19, which allows passage downwardly as viewed in FIG. 1, but intercepts guides on tractor vehicles moving upwardly (in reverse) in FIG. 1.

The branch 18 may, if desired, be divided into two tracks 21 and 22, but a single track will carry out the invention. For this switching operation, a triangular frog 23 is provided under the control of a Bowden wire 24 and a manual slide button 26.

Disposed at the left end of each branch 21 and 22 is a reciprocating dock 27 provided particularly in accordance with the invention, and each dock has under it an elastic air bellows 28 also provided particularly in accordance with the invention. To the right of the loading docks 27 in each branch is a pair of ramps 29 provided particularly in accordance with the invention.

Figure 2:
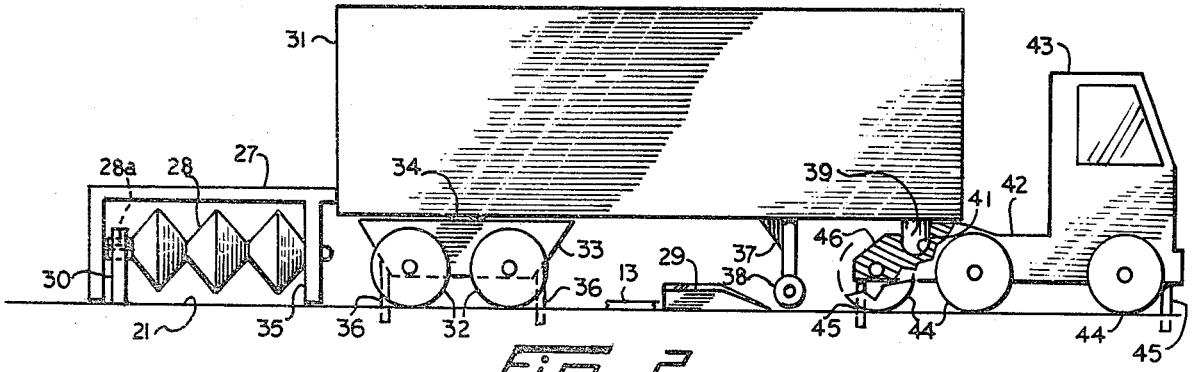
FIG. 2 is an elevation view on an enlarged scale of one of the loading docks and roads of FIG. 1 with the loading dock being contacted by a semitrailer.
Figure 3:
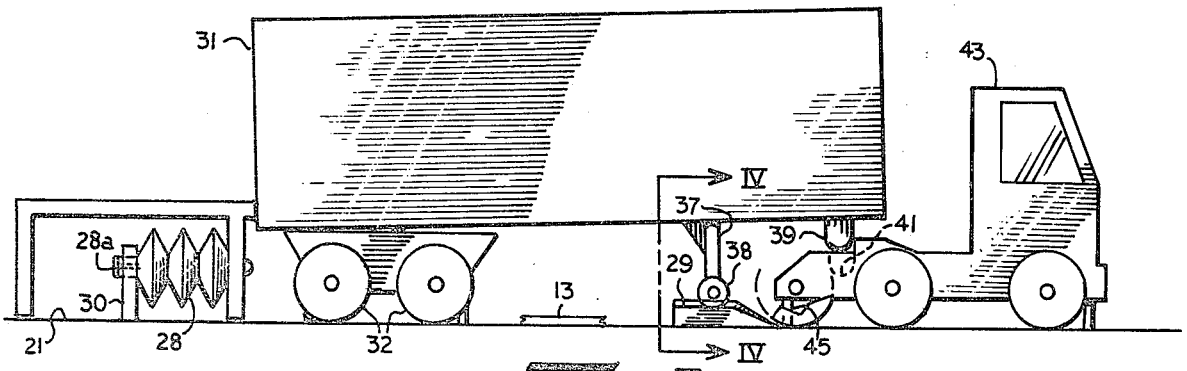
FIG. 3 is an elevation view similar to FIG. 2, but showing the loading dock reciprocated to the left and with the front end of the semitrailer elevated so that the truck tractor may move away from the semitrailer.
Figure 4:
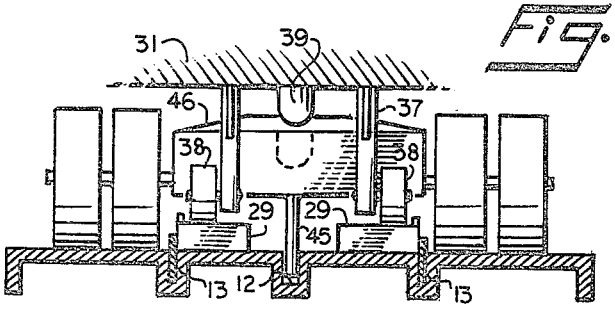
FIG. 4 is a sectional view of the roadway and part of the trailer and truck tractor taken along the line IV—IV of FIG. 3.

Referring now to FIGS. 2, 3, and 4, disposed on the roadway 21 is a semitrailer 31 having rear wheels 32, which are preferably spaced outwardly from the conductors 13 on the roadway 21. While a single pair of wheels 32 could be provided, one on each side of the trailer 31, there is illustrated two pairs of wheels 32 mounted on a rotatable truck or carriage 33 having a pivot at 34. We have found that this pivoted truck or carriage 33 reduces friction loads while the vehicle is being pulled around curves, and in order to make it track properly we have determined that there should be two guide stems 36, one forward of the pivot and one rearward of the pivot, both of them having their bottom ends fitting into the groove 12. We have found that this type of dual guidance gives great freedom from friction at the turns when the semitrailer 31 is being towed.

Referring now to the forward end of the semitrailer 31, that is to the right in FIGS. 2 and 3, a pair of downwardly projecting struts 37 secured to the semitrailer 31 support a similar pair of dolly wheels 38. These dolly wheels preferably just clear the roadway 21 when the semitrailer is being towed. Also referring to the righthand end of the trailer 31, there is a downwardly projecting king pin 39, which fits into a pin recess 41 on a pivot platform 42 formed on the rear of a tractor truck 43. The tractor truck 43 may have three pairs of wheels 44 to simulate heavy-duty trucks, and any one pair of these wheels may be driven by an electric motor (not shown) in the tractor 43, which derives its current from the conductors 13, as is well known in the industry. The spacing of the wheels of a pair is preferably the same as that of the outward spacing of the wheels of the semitrailer, that is, outwardly from the electrical conductors 13. The truck tractor 43 may also be provided with a pair of forward and rearward guide pins 45 to eliminate the necessity for steering mechanisms on the tractor. The rear edge of the tractor 43 is formed particularly in accordance with the invention and has a beveled surface 46, the lower edge of which is below the lowermost point of the king pin 37 when the dolly wheels 38 are resting on the roadway 21. This beveled surface 46 enables the coupling of the tractor 43 to the semitrailer 31.

Figure 5:
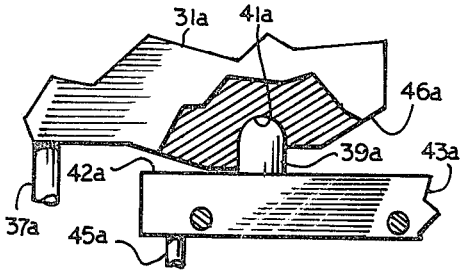
FIG. 5 is a fragmentary elevation view of a modified form of the invention wherein the king pin projects from the tractor into a recess in the trailer.

Referring now to FIG. 5, there is illustrated a modification of the invention wherein a tractor truck 43*a* has a pivot platform 42*a*, which has an upwardly projecting pin 39*a*, which fits into a recess 41*a* in a semitrailer 31*a*. The forward edge of the semitrailer 31*a* may be beveled at 46*a* to provide for a coupling of the two vehicles. The pivot pin recess 41*a* is forward of a dolly wheel strut 37*a*, and the rear of the tractor 43*a* may be guided by a pin 45*a*. This disclosure of FIG. 5 merely reverses the assembly of pin and recess shown in FIGS. 2, 3, and 4.

OPERATION

The operation of the bellows 28 inside the loading dock 27 is best illustrated by comparing FIGS. 2 and 3. The bellows 28 have a stem with an interior passage 28*a*, which ejects air when the bellows are compressed and which takes in air when the bellows expand. This stem is held by an upright post 30 connected to the roadway 21, and the other end of the bellows 28 is held in a downwardly depending leg 35 at the righthand end of the dock 27. The bellows 28 are preferably made of an elastic type of plastic or metal so that air is compressed when the bellows are compressed as shown in FIG. 3. During this compression, air ejects through the passage 28*a* in a metered fashion, which is not important on the compression stage, but more importantly allows the bellows to fill up slowly when the compression force is removed.

Referring now to FIG. 1, the tractor 43, when coupled to the semitrailer 31, proceeds downwardly on the lefthand part of the roadway 10. The guide pins 45 on the tractor 43 push aside the flexible finger 19 in the track 12, and likewise the guide pins 36 at the rear of the trailer 31 push aside this flexible finger 19. When the entire tractor and trailer are past the flexible finger 19, the operator operates the control 17 to stop the vehicle and then causes the polarity of the current in the conductors 13 to be reversed, whereupon the trailer and tractor back up and their guide pins are then intercepted by the flexible finger 19 to direct both parts of the vehicle to the branch roadway 18. The frog 23 is then actuated by the mechanical switching device 26 to direct the guide pins into one track 21 or the other track 22, the operations of which are identical.

Referring now to FIG. 2, the tractor 43 with its attached semitrailer 31 backs up, that is, to the left in FIG. 2, until the back of the semitrailer strikes the reciprocating dock 27, which then causes the dock to move to the left, compressing the bellows 28. As the bellows are compressed, the dolly wheels 28 ride up the ramp 29 until the front of the semitrailer 31 is elevated as shown in FIG. 3. The operator then reverses the current through his control 17 to cause the tractor vehicle 43 to move to the right and leave the semitrailer in the position shown in FIG. 3, where the pin 39 is removed from the pin recess 41. There it will be noted that the dolly wheels 38 have ridden up on top of the ramps 29 to cause this elevation.

Referring still to FIG. 3, when the tractor 43 has been removed by moving to the right, the elasticity of the bellows 28 causes it to act like a compression spring and the bellows 28 expand slowly because of the metering effect of air entering the passageway 28*a*. The dock 27, therefore, will move to the right, pushing the semitrailer 31 to the right until the dolly wheels rest on top of the roadway 21 as shown in FIG. 2. The trailer 31 is then in the position to be reconnected to a tractor 43. The operator of this system thereupon uses his control 17 to cause the tractor 43 to back up toward the semitrailer 31 of FIG. 2. The beveled edge 46 at the rear of the tractor 43 then will strike the pin 39, causing a camming action to lift the front end of the semitrailer 31. The bottom end of the pin 39 then rides along on top of the pivot platform 42 of the tractor until it reaches the pin recess 41, whereupon the pin drops by gravity into this recess.

This entire coupling action is made possible by virtue of the fact that the pin 39 and the pin recess 41 are on the same longitudinal axis. This is achieved by virtue of the guidepins 45 on the tractor on the same exact axis that it had when the uncoupling action of FIG. 3 occurred.

The operation of the modification of FIG. 5 is similar to that described in connection with FIGS. 2 and 3.

It will be realized by those skilled in the art that various modifications may be made in the apparatus illustrated. For example, the bellows could be replaced by a compression spring that is frictionally slowed down to give metered or controlled expansion and contraction. The bellows 28 acts effectively, because it is also a spring as well as a bellows. For these and various other reasons, the invention is not limited to the disclosed structures, and all variations and modifications that fall within the true spirit and scope of the invention are included within the scope of the following claims.

In the claims, the words "cam surface" include the ramp, the words "coupling means" include the kingpin and recess, and the words "follower means" include the dolly wheels.

We claim:

1. Apparatus for coupling a first toy vehicle from a second toy vehicle on a roadway, comprising:

(a) coupling means associated with said first and second toy vehicles for coupling said toy vehicles and for releasing said toy vehicles upon relative vertical displacement between said toy vehicles;

(b) a cam surface on said roadway;

(c) follower means connected to said first toy vehicle for operative engagement with said cam surface to cause relative vertical displacement between said first and second toy vehicles;

(d) and resilient means for moving said first toy vehicle off said cam surface on said roadway, said resilient means being provided with a delay means for slowing the rate of moving the first vehicle off the cam surface, whereby operative engagement of said cam surface and said follower means causes said coupling means to release said vehicles and whereby said delay means enables the second vehicle to be moved before the first vehicle is moved off the cam surface.

2. Apparatus for disconnecting a toy semitrailer from a truck tractor, both disposed on a roadway, comprising:

(a) a toy truck tractor having a pin recess at the rear;

(b) a toy semitrailer having front dolly wheels and having a downwardly projecting king pin forward of the dolly wheels for fitting into the pin recess;

(c) and a ramp on the roadway having a height greater than the penetration of the king pin into the tractor pin recess;

(d) resilient means for moving said truck trailer off said ramp;

(e) and a beveled rear edge on said truck tractor starting at a distance from the roadway approximately at the distance of the bottom of the king pin from the roadway, whereby moving the front of the semitrailer over the ramp causes the dolly wheels to engage the ramp to raise the front of the semitrailer sufficiently to disengage the king pin from the pin recess, allowing the truck tractor to thereafter move away from the semitrailer; the resilient means thereafter moves the semitrailer off the ramp and relative movement between the semitrailer and the truck tractor will move the king pin up the bevel and into the pin recess.

3. Apparatus as set forth in claim 2 wherein a guide is provided for the truck tractor to center the truck tractor with respect to the semitrailer king pin, so that the king pin will fall into the pin recess when the truck tractor is backed into the semitrailer.

4. Apparatus as set forth in claim 3 wherein the guide comprises means forming a groove in the roadway and a guide stem projects downwardly from the rear of the truck tractor into the groove.

5. Apparatus as set forth in claim 2 wherein the resilient means is provided with a delay means for slowing the rate of moving the semitrailer off the ramp, whereby the truck tractor may be removed before the semitrailer is moved off the ramp.

6. Apparatus for disconnecting on a roadway a toy semitrailer from a toy truck tractor at a loading dock, comprising:

(a) a horizontally reciprocating loading dock;

(b) a roadway leading to the dock and having a guide parallel to the traffic direction on the roadway;

(c) a toy semitrailer having spaced rear wheels and front dolly wheels inboard of the rear wheels and a guide stem projecting from the semitrailer to contact the roadway guide and having a downwardly projecting king pin foward of the dolly wheels;

(d) a toy truck tractor having rear wheels and a pivot platform at the rear having a pin recess to receive the king pin and having a beveled rear edge starting at a distance from the roadway less than the distance of the bottom of the king pin from the roadway;

(e) resilient means urging the dock toward the roadway;

(f) delay means for slowing the rate of reciprocation of the dock toward the roadway;

(g) and a ramp on the roadway inboard of the semitrailer rear wheels at the approximate distance from the loading dock at which the dolly wheels strike the ramp when the rear of the semitrailer strikes the reciprocable dock, whereby rearward movement of the semitrailer causes the dock to reciprocate and the dolly wheels to lift the front of the semitrailer to release it from the truck tractor, and the delay means allows the truck tractor to move away before the resilient means moves the semitrailer forward off the ramp, and coupling is effected by backing the truck tractor against the king pin causing it to ride up the bevel to seat in the pin recess.

7. Apparatus for disconnecting on a roadway a toy semitrailer from a toy truck tractor at a loading dock, comprising:

(a) a horizontally reciprocating loading dock;

(b) a roadway leading to the dock and having a guide parallel to the traffic direction on the roadway;

(c) a toy semitrailer having spaced rear wheels and front dolly wheels inboard of the rear wheels and a guide stem projecting from the semitrailer to contact the roadway guide and having a king pin recess forward of the dolly wheels and having a beveled front edge having a top of the bevel;

(d) a toy truck tractor having rear wheels and a king pin projecting upwardly at the rear, the top of the king pin being at a distance from the roadway less than the distance of the top of the bevel from the roadway;

(e) resilient means urging the dock toward the roadway;

(f) delay means for slowing the rate of reciprocation of the dock toward the roadway;

(g) and a ramp on the roadway inboard of the semitrailer rear wheels at the approximate distance from the loading dock at which the dolly wheels strike the ramp when the rear of the semitrailer strikes the reciprocable dock, whereby rearward movement of the semitrailer causes the dock to reciprocate and the dolly wheels to lift the front of the semitrailer to release it from the truck tractor, and the delay means allows the truck tractor to move away before the resilient means moves the semitrailer forward off the ramp, and coupling is effected by backing the truck tractor so that the king pin rides on the bevel to seat in the pin recess.

8. Apparatus for uncoupling a first toy vehicle from a second toy vehicle on a roadway, comprising:

(a) coupling means associated with said first and second toy vehicles for coupling said toy vehicles and for releasing said toy vehicles upon relative vertical displacement between said toy vehicles;

(b) a first cam surface on said roadway;

(c) follower means connected to said first toy vehicle for operative engagement with said cam surface to cause relative vertical displacement between said first and second toy vehicles, to uncouple said vehicles;

(d) said coupling means including at least two mating elements for coupling said toy vehicles, one of said mating elements being located on one of said toy vehicles and the other of said mating elements being located on the other of said toy vehicles;

(e) and a second cam surface on at least one of said toy vehicles for operative engagement with the mating element which is located on the other of said toy vehicles to cause relative vertical displacement between said toy vehicles such that said mating elements come into engagement to couple said toy vehicles, whereby operative engagement of said cam surface and said follower means causes said coupling means to release said vehicles.

9. Apparatus for disconnecting a toy semitrailer from a truck tractor, comprising:

(a) a toy truck tractor;

(b) a toy semitrailer having front dolly wheels;

(c) king pin and pin recess means on said truck tractor and semitrailer located at the rear of the truck tractor and forward of the dolly wheels;

(d) a ramp having a height greater than the penetration of the king pin into the pin recess;

(e) and resilient means for moving the semitrailer off the ramp, whereby moving the front of the semitrailer over the ramp causes the dolly wheels to engage the ramp to raise the front of the semitrailer sufficiently to disengage the king pin from the pin recess, allowing the truck tractor to thereafter move away from the semitrailer, and said resilient means moving the semitrailer off the ramp for connection to a truck tractor.

* * * * *